US007083351B2

(12) United States Patent
Gueret

(10) Patent No.: US 7,083,351 B2
(45) Date of Patent: Aug. 1, 2006

(54) DEVICE FOR APPLYING A SUBSTANCE, IN PARTICULAR A COSMETIC, AND ITS METHOD OF MANUFACTURE

(75) Inventor: Jean-Louis Gueret, Paris (FR)

(73) Assignee: L'Oreal (FR)

( * ) Notice: Subject to any disclaimer, the term of this patent is extended or adjusted under 35 U.S.C. 154(b) by 0 days.

(21) Appl. No.: 10/438,363

(22) Filed: May 14, 2003

(65) Prior Publication Data

US 2004/0047673 A1 Mar. 11, 2004

Related U.S. Application Data

(60) Provisional application No. 60/391,044, filed on Jun. 25, 2002.

(30) Foreign Application Priority Data

May 17, 2002 (FR) ..... 02 06089

(51) Int. Cl.
*B43K 5/00* (2006.01)
*B05C 2/00* (2006.01)

(52) U.S. Cl. ..... 401/196; 264/45.9; 264/46.3

(58) Field of Classification Search ..... 401/9, 401/11, 130, 196, 261, 266; 132/293, 317; 15/229.14, 244.1–244.4; 264/45.5, 45.7, 264/45.9, 46.1–46.3
See application file for complete search history.

(56) References Cited

U.S. PATENT DOCUMENTS

| | | | | |
|---|---|---|---|---|
| 1,375,938 | A * | 9/1921 | Slack | 401/130 |
| 3,068,545 | A | 12/1962 | Stiner | |
| 3,708,833 | A * | 1/1973 | Ribich et al. | 24/450 |
| 3,821,065 | A * | 6/1974 | Copeland | 428/77 |
| 4,698,871 | A * | 10/1987 | Patkos | 15/229.14 |
| 4,776,356 | A | 10/1988 | Jou et al. | |
| 4,856,136 | A * | 8/1989 | Janssen | 15/244.3 |
| 4,908,252 | A | 3/1990 | Carnahan et al. | |
| 5,346,753 | A * | 9/1994 | Ostrower | 15/229.14 |
| 6,044,512 | A | 4/2000 | Hornby et al. | |
| 6,283,664 | B1 * | 9/2001 | Gueret | 401/261 |
| 6,669,389 | B1 * | 12/2003 | Gueret | 401/122 |

FOREIGN PATENT DOCUMENTS

| | | | |
|---|---|---|---|
| DE | 196 33 687 | A1 | 2/1998 |
| GB | 2348806 | A * | 10/2000 |

* cited by examiner

*Primary Examiner*—Tuan Nguyen
(74) *Attorney, Agent, or Firm*—Lerner, David, Littenberg, Krumholz & Mentlik, LLP

(57) ABSTRACT

A device for applying a substance, the device including an applicator member having at least one of a fibrous and cellular element. The element defines a surface for applying the substance. At least a portion of the surface includes projecting fibers. The projecting fibers are attached to a portion of the element. The portion of the element and the fibers may be made out of the same material.

36 Claims, 4 Drawing Sheets

DEVICE FOR APPLYING A SUBSTANCE, IN PARTICULAR A COSMETIC, AND ITS METHOD OF MANUFACTURE

CROSS REFERENCE TO RELATED APPLICATIONS

This application claims the benefit of PCT Application No. 02 06089, France, filed May 17, 2002 and U.S. Application No. 60/391,044 filed Jun. 25, 2002, the disclosures of which are incorporated by reference herein.

BACKGROUND OF THE INVENTION

The present invention relates to devices for applying a substance, in particular a cosmetic, and their methods of manufacture.

The term "cosmetic" is used to mean a substance as defined in EEC Council Directive 96/35 of Jun. 14, 1993, amending for the sixth time EEC Directive 76/768.

Numerous applicator devices are known comprising an applicator member made of foam having a surface that is used for applying substance on the skin, for example a powder, a lotion, or a cream.

In order to increase the uniformity of the resulting makeup, or to improve comfort of application, the foam is sometimes covered in flocking. For some substances, the presence of the flocking can reduce the quantity of substance which the applicator member can take up. This leads to smaller coverage and obliging the user to refill the applicator member more frequently with substance.

In addition, it has been found that by using foams shaped by cutting with a sharp tool, the walls of the cells present at the surface of the foam have a tendency to scrape the substance on the skin, thus making it difficult to deposit an appropriate thickness thereof.

SUMMARY OF THE INVENTION

Consequently, there exists a need to benefit from an applicator device comprising an applicator member which is simultaneously comfortable in application and capable of depositing a desired quantity of substance on the skin.

In one of its aspects, the present invention provides a device for applying a substance, in particular a cosmetic. The device includes an applicator member having at least one fibrous or cellular element with a surface that is used for applying the substance. The device is characterized by the fact that at least a portion of the surface has projecting fibers. The fibers being made out of the same material constituting the portion of the element to which they are attached.

The term "fiber" should be understood broadly and covers structures that need not be totally in the form of threads. For example, structures presenting one or more free ends or one or more zones (e.g. two or three zones) that are connected to the remainder of the element. Thus, a fiber may include ramifications, for example. A fiber may have one or more thread-like extensions having free ends, and it may be connected in a flexible manner to the remainder of the element. The fibers are made integrally with the portion of the element to which they are attached.

By means of the present invention, the surface of the element used for application can be made more comfortable and more suitable for picking up an increased quantity of substance. The fibers may form a covering of down extending over more than one-fourth, or indeed more than one-half, e.g. three-fourths of the surface area used for application purposes. The element may be elastically deformable and/or compressible. The element may be a felt or a foam. Additionally, the felt or foam may be made of a single material. The term "felt" is used herein to mean a fiber structure comprising filaments that are tangled in all directions. Such a structure can be relatively compact.

At least a fraction of the fibers may be formed by the walls of the cells that have burst. Such a covering of down may lead to softness in the application comparable to that provided by flocking, while avoiding the drawbacks thereof.

The above-mentioned down may extend over a surface area of the foam which corresponds, for example, to more than half the application surface area. A major fraction of the fibers may present ramifications.

The foam may include craters in its surface. The craters may be of a depth of not less than 0.4 millimeters (mm) and possibly not less than 0.7 mm. The craters may even have a depth of not less than 1.3 mm or even not less than 1.5 mm. Such craters may be obtained by removing the walls from a group of cells, the group comprising five to fifteen cells. The craters make it possible for the foam to contain at its surface a quantity of substance that is greater than the quantity possible when the foam has been cut by means of a sharp tool and has not been subjected to subsequent treatment. The fibers may extend from around each crater.

The craters may be disseminated, in particular they may be regularly disseminated, over a surface area of the foam. The surface area of the craters may correspond to more than half the application surface area of the device.

The foam may include a lattice of thread-like walls, being made from a material selected from the following list: polyurethane, polyether, polyester, polyvinyl chloride, and ethylene vinyl acetate (EVA). This list serving as an example rather than a limitation. The element may present hydrophilic properties, and in particular it may incorporate at least one water-absorbing compound, e.g. a polyacrylate.

Even though the foam may present hydrophilic properties, and possibly includes water-absorbing compounds, the fact that the foam presents a surface state as defined above can further reinforce its affinity for substances that contain water. By way of example, the applicator member may constitute a sponge which is independent of any support. The applicator member may be used to take a substance from a receptacle and may be housed in the receptacle while it is closed and not in use. The applicator member may be secured to a support. The support may include a handle or knob that is also suitable for constituting a closure member for a receptacle containing the substance.

The applicator member may comprise a first foam element fixed to a second foam element so as to form an applicator member associated with a support, or in a variant a sponge that is independent of any support. Between them, the two elements may define an internal cavity, for example a cavity filled with air, thus giving the applicator member greater flexibility during application. The two elements may present surface states that are either substantially identical, or else differ from one another.

The applicator member may be fixed by means of a central region to a support and it may present a free peripheral region, e.g. capable of flexing when pressed against the surface onto which the substance is to be deposited. The surface of the applicator member used for application may be outwardly concave. Such a shape making it possible to increase the quantity of substance with which the applicator member can pick up.

The element may still further include flocking.

The applicator member may present two portions of its surface serving for application purposes and having different surface states. For example, one surface state may correspond to a sharp element cutting into the foam, while the other surface state is different. For example, the other surface state may correspond to treating the foam with an abrasive tool. The abrasion may be performed by means of an abrasive wheel, a milling cutter, or a brush. The abrasion may be performed while the element is compressed.

In another of its aspects, the present invention provides a method of manufacturing an applicator device in which a surface of the device includes a fibrous or cellular element. The surface, which is to be used as an applicator surface, is treated in such a manner as to form fibers from the material of the element. The fibers thus projecting from the surface of the element. Such a surface state may be obtained in particular by subjecting the surface of the element to abrasive treatment. This makes it possible with a foam to burst the walls of the cells present at the surface of the foam, thereby creating down and craters.

The abrasive treatment may be performed by means of an abrasive wheel, a milling cutter, or a brush, and it may take place while the element is compressed.

The surface state may differ depending on the roughness of the abrasive wheel, the milling cutter that is used, the nature of the brush or the pressure that is exerted on the element while it is being treated.

The general shape of the element before and after the abrasive treatment need not be significantly modified. However, the abrasive treatment may contribute, in a variant, to giving the element its final shape.

In another of its aspects, the present invention also provides a device comprising an applicator member having at least one fibrous or cellular element. In particular a foam, having a surface for use in applying the substance. The device is characterized by the fact that at least a portion of the surface presents a surface state different from that which would be obtained by cutting the element by means of a sharp tool.

In another of its aspects, the present invention provides a kit for packaging and applying a cosmetic product. The kit may include a receptacle containing the cosmetic to be applied and an applicator device as defined above.

In another of its aspects, the present invention also provides a method of manufacturing an applicator device with a fibrous or cellular surfaces, particularly a foam. The surface is to be used, at least in part, as an applicator surface and is treated in a manner that gives it a surface state that is different from the surface state that would be obtained by cutting the element with a sharp tool.

BRIEF DESCRIPTION OF THE DRAWINGS

The present invention will be better understood upon reading the following detailed description of non-limiting elements, and on examining the accompanying drawings, in which.

DETAILED DESCRIPTION

Figure 1:
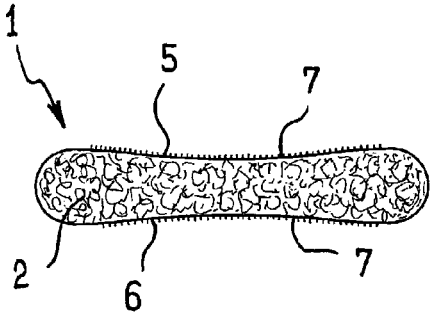
FIG. 1 is a front view of a sponge made in accordance with the present invention.

FIG. 1 shows a sponge 1 for use in applying a powder on the skin.

In the example shown, the sponge 1 is constituted by a block of open-celled foam, e.g., a flexible polyurethane foam. In a variant, the sponge may be made of felt.

Figure 2:
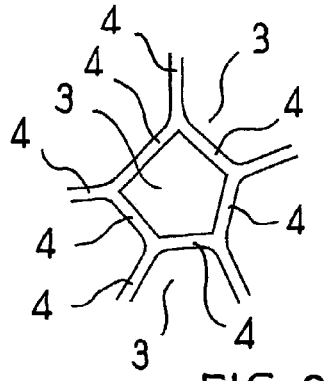
FIG. 2 is an enlarged view of a foam showing a cell according to an embodiment of the present invention.

FIG. 2 details that each cell 3 is formed by a plurality of interconnected thread-like walls 4 extending in multiple directions. By way of example, each cell may comprise a succession of four or five walls 4 each of which is substantially rectilinear and together forming a loop.

Figure 3:
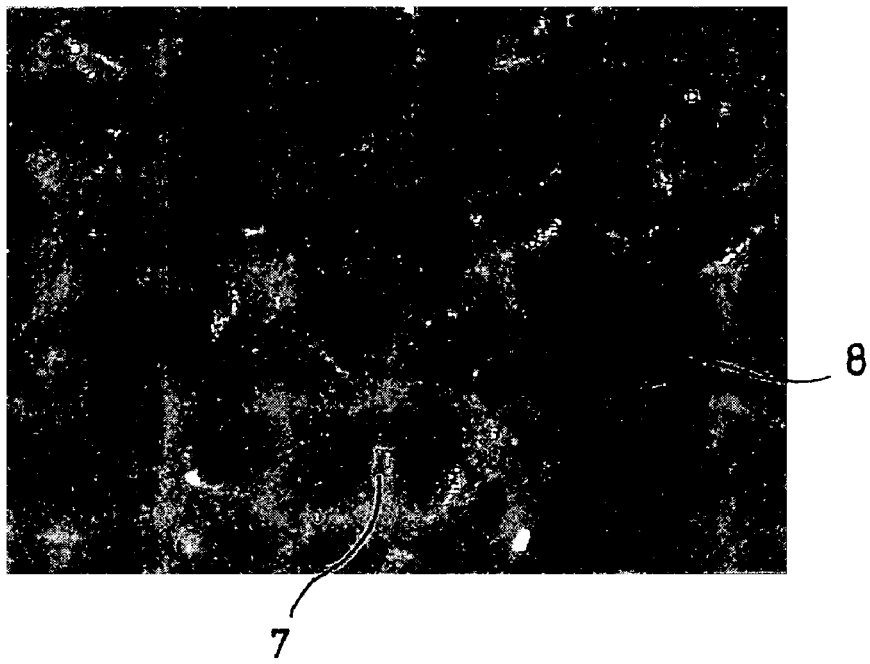
FIG. 3 is a photograph of the surface of a foam after an abrasive treatment.

The sponge 1 shown in FIG. 1 has two main opposite faces 5 and 6 that are both slightly concave away from the exterior of the sponge 1. Each face 5 and 6 has received an abrasive treatment in order to form down 7 and craters 8 in their respective surfaces. The down 7 is formed by the shredded walls of cells, as can be seen in the photograph of FIG. 3. The surface state of the faces 5 and 6 is thus different from the surface state that would be obtained by cutting the foam by means of a sharp tool. For example, FIG. 4 is a photograph of the surface of a foam after being cut by means of a sharp tool.

Figure 4:
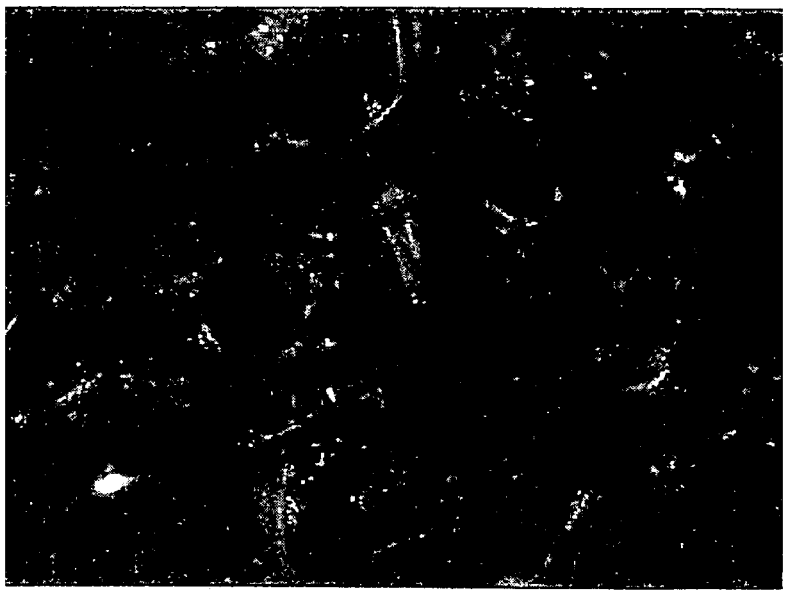
FIG. 4 is a photograph of the surface of a foam obtained by cutting the foam with a sharp element.

By comparing FIGS. 3 and 4, it can be seen that the surface of the foam that has been subjected to an abrasive treatment presents shredded cells forming the fibers that constitute the down 7 and the craters 8 that are created by removing groups of cells.

Figure 5:
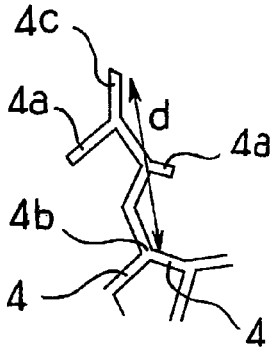
FIG. 5 shows an example of a fiber in isolation according to the present invention.

FIG. 5 shows an example of a fiber obtained by destructuring the surface of the foam. In this figure, it can be seen that the fiber has ramifications 4*a* which may optionally be coplanar. The distance d measured between a free end 4*c* of the fiber and an end 4*b*, where the fiber is connected to the remainder of the element (i.e. to the substance that has not been damaged), may be greater than the mean length of a cell wall 4.

The depth of a crater 8 may be determined by using an optical method, for example, which consists of using a microscope and focusing it initially on the walls 4 surrounding the crater 8. Next, the microscope is focused on the walls 4 constituting the bottom of the crater 8, and a reading relating to the displacement of the microscope between the two positions may then be computed. Using this method, it is possible to measure the mean depth of the craters 8, which may be greater than 0.7 mm.

Figure 6A:
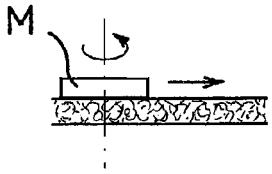
FIGS. 6A to 6D are side views of different tools in contact with a surface of the sponge in FIG. 1 that can be used for treating the foam.
Figure 6B:
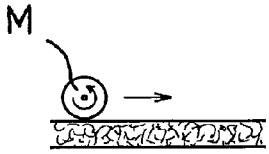
Figure 6C:
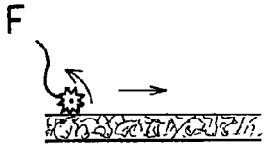
Figure 6D:
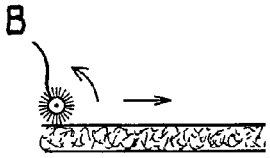

Various tools may be employed in order to perform the abrasive treatment on the fibrous or cellular element. Additionally, the treatment may be performed while the surface being treated is substantially plane with (the element then resting on a plane support, for example). The treatment may be performed by moving an abrasive wheel M over the surface of the element. The wheel being driven to rotate about an axis substantially perpendicular to the treated surface (FIG. 6A) or substantially parallel to the treated surface (FIG. 6B). A cutter F (FIG. 6C) or a brush B (FIG. 6D) alternatively may be used as well.

The number and depth of the above-mentioned craters 8, as well as the length of the fibers depend on the type of abrasive treatment that is performed. Additionally, the pressure exerted on the foam while it is being abraded and the surface state of the tool used for treating the foam also determine the crater 8 and fiber features.

By way of example, the depth of the craters 8 can be greater or smaller. In preferred embodiments, the depth is in the range of 0.4 mm to about 2 mm. The fibers created by abrasion may extend substantially all around each crater 8. The presence of the down 7 and of the craters 8 procures numerous advantages. First, the down 7 makes the foam softer during application and serves to avoid scraping between the substance that has been deposited on the skin and the foam.

In addition, the craters 8 constitute cavities in which substance can accumulate while the applicator surface is being loaded. Thus, the applicator surface presents an enhanced ability to pick up substance. This result improves coverage and/or extends the length of time the applicator member may be used before needing to be refilled.

Figure 7:
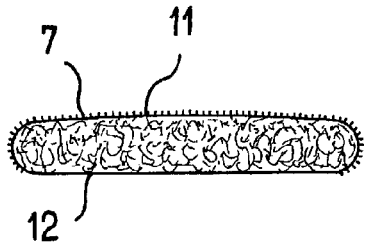
FIGS. 7 to 10 show various differing sponges.

FIG. 7 shows an additional embodiment of a sponge according to the present invention having a face 11 which has been subjected to an abrasive treatment. The sponge presents a surface having down 7 disposed on it. The opposite face 12 may be obtained using conventional cutting techniques. The opposite face 12 presents a surface state similar to that shown in FIG. 4. Either of the faces 11 and 12 may be used for applying a substance depending on the effect a user may desire.

Figure 8:
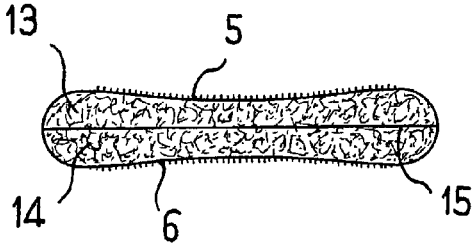

The applicator member may be defined by a single block of cellular or fibrous material, in particular a foam, (as is the case in the examples of FIGS. 1 and 7). In a variant, the applicator member may comprise an assembly of at least two elements, in particular two foam elements. FIG. 8 shows a sponge which differs from that shown in FIG. 1 by the fact that the block of foam 2 is replaced by two foam elements 13 and 14 which are assembled together on a midplane 15.

Figure 9:
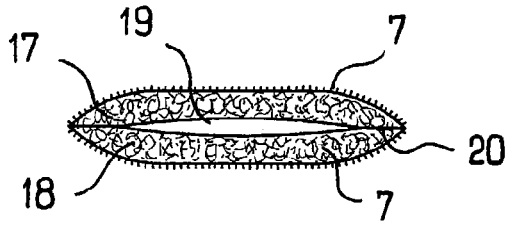
Figure 10:
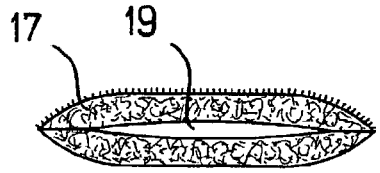

It is also possible to provide a cavity within the sponge as shown in FIGS. 9 and 10.

FIG. 9 shows a sponge formed by assembling together two foam elements 17 and 18. Each of the elements 17 and 18 has received an abrasive treatment on one face. The two elements form between them a cavity 19 that is filled with air. The elements 17 and 18 may be assembled together by being heat-sealed at their periphery 20 around the cavity 19.

The example of FIG. 10 differs from that of FIG. 9 in that only element 17 has received an abrasive treatment on its outside face.

In the examples described above, the applicator member constitutes a sponge, sometimes also known as a "powder puff".

It would not go beyond the scope of the present invention for the applicator member to be secured to a support, as described below with reference to FIGS. 11 to 16.

Figure 11:
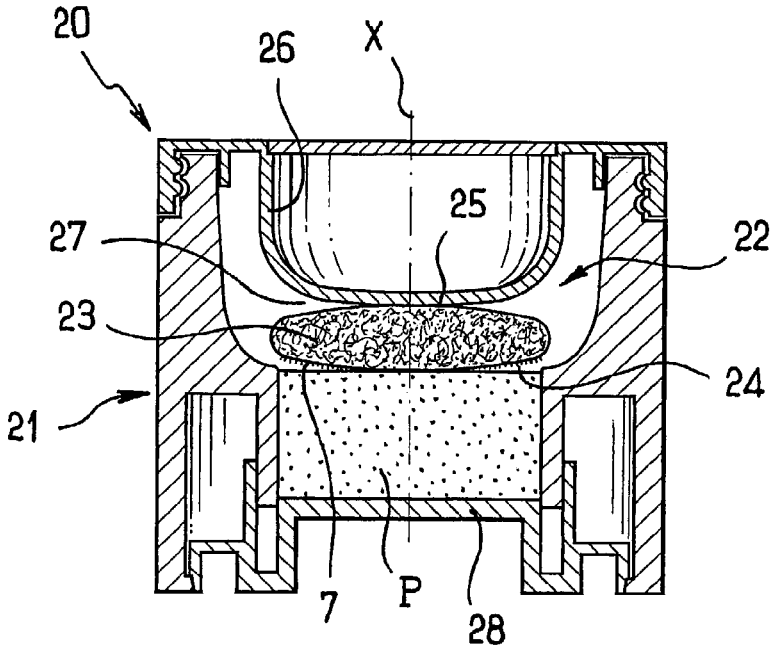
FIGS. 11 to 16 are fragmentary diagrams showing various embodiments of the present invention in use.

FIG. 11 shows a packaging and application kit 20 which comprises a receptacle 21 and an applicator device 22. The applicator device comprises an applicator member constituted by a foam element 23. The foam element 20 has received an abrasion treatment on at least a portion of its face 24 thereby forming down 7 and craters 8 on face 24.

The foam is fixed via its opposite face 25 to a support 26 also constituting a member for closing the receptacle.

In the example shown, it should be observed that the peripheral region of the element is free, leaving a gap 27 relative to the support. Thus making it possible to give the applicator member greater flexibility.

The receptacle may have a moving bottom wall 28, enabling the substance P to be urged towards the applicator member 23.

Figure 12:
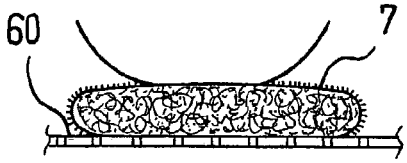

Naturally, it would not go beyond the scope of the present invention for the receptacle to be made in some other manner, for example having a screen 60 as shown in FIG. 12.

The applicator member may be secured to a rigid or flexible support which need not constitute an element for closing a receptacle.

Figure 13:
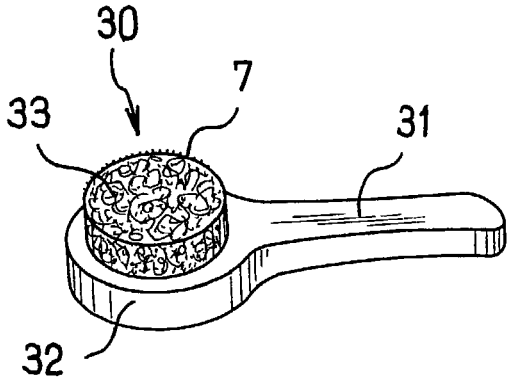

By way of example, FIG. 13 shows a device 30 for applying a substance. The device comprises a handle 31 provided with a head 32 having a block 33 of foam fixed on one face thereof. The foam has received an abrasion treatment on its surface in order to form down 7 and craters 8.

Figure 14:
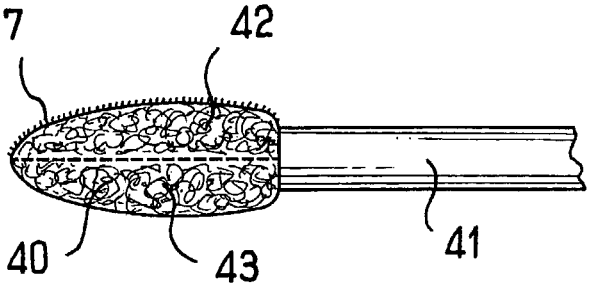

FIG. 14 shows another example in which the applicator member 40 is secured to a rod 41 shown in part only. The rod 41 may be used to remove substance from a receptacle. Optionally, a wiper member may be provided to remove excess substance from the rod 41.

In general, and as applies in particular to this example, the applicator member may comprise a first portion 42 whose surface has received abrasive treatment and a second portion 43, (e.g. diametrically opposite the first), whose surface has not received any abrasive treatment.

Figure 15:
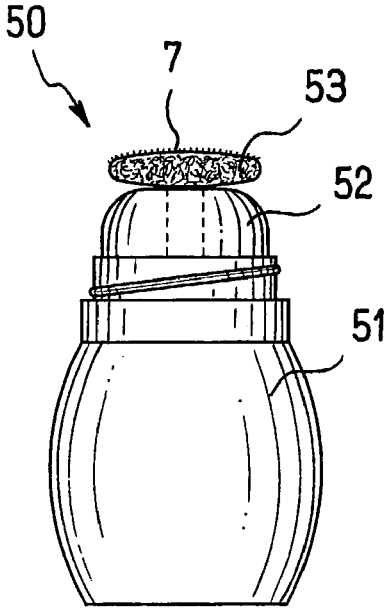

As shown in FIG. 15, the applicator member may also be secured to a receptacle containing the substance for application.

Figure 16:
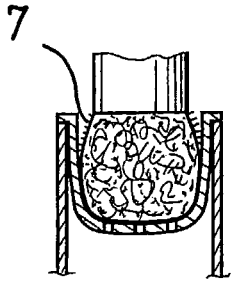

FIG. 15 shows a kit 50 comprising a receptacle 51 with a dispenser endpiece 52 at its top end in the form of a dome. The applicator member 53 is annexed to the dispenser end piece 52. The applicator member being constituted by a foam element whose outside surface has received an abrasion treatment in order to form down and craters. The applicator member 53 may also be received in a housing whose bottom wall includes at least one orifice for feeding substance, as shown in FIG. 16. In this figure it can be seen that the cellular or fibrous element can be configured in such a manner as to have its periphery bearing against a side wall of the housing, and possibly also bearing against the bottom wall of the housing.

The present invention is not limited to the examples described above, and some or all of their characteristics can be used in combination.

Throughout the description, including in the claims, the term "including a" should be understood as being synonymous with "including at least one" unless specified to the contrary.

Although the present invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. A cosmetic device comprising:

an applicator member for applying a cosmetic product to a person, said applicator having at least one of a fibrous and cellular element, said element defining a surface for applying said substance, wherein at least a portion of said surface comprises projecting fibers, said projecting fibers being attached to a portion of said element, wherein said portion of said element and said fibers are made out of a same material, wherein said fibers are obtained by subjecting said element to an abrasive treatment prior to a first use of the applicator member.

2. The device according to claim 1, wherein said fibers form a covering extending over more than half of said surface used for application purposes.

3. The device according to claim 1, wherein said element is elastically deformable.

4. The device according to claim 1, wherein said element is compressible.

5. The device according to claim 1, wherein said element is a felt.

6. The device according to claim 1, wherein said element is a foam.

7. The device according to claim 6, wherein at least a portion of said fibers is constituted by a plurality of walls of burst cells.

8. The device according to claim 6, wherein at least a portion of said fibers have ramifications.

9. The device according to claim 6, wherein a major portion of said fibers have ramifications.

10. The device according to claim 7, wherein said plurality of walls of said burst cell has a mean length, wherein said fibers have a free end and a connection end, wherein a majority of said fibers have a distance between said free end and said connection end that is greater than said mean length.

11. The device according to claim 6, wherein said surface of said foam includes at least one crater, said crater having a depth of not less than 0.4 mm.

12. The device according to claim 11, wherein said crater has a depth of not less than 0.7 mm.

13. The device according to claim 12, wherein said crater presents a depth of not less than 1.5 mm.

14. The device according to claim 11, wherein said craters are spread out over a foam surface area, said foam surface area corresponding to more than half the application surface area.

15. The device according to claim 6, wherein said foam comprises a lattice of thread-like walls.

16. The device according to claim 6, wherein said foam is made of a material selected from the following list: polyurethane, polyether, polyester, polyvinyl chloride, and ethylene vinyl acetate (EVA).

17. The device according to claim 6, wherein said applicator member comprises two assembled-together foam elements.

18. The device according to claim 17, wherein said two elements define an internal cavity.

19. The device according to claim 1, wherein said element presents hydrophilic properties.

20. The device according to claim 1, wherein said element incorporates at least one water-absorbing compound.

21. The device according to claim 1, including a receptacle containing a substance for application.

22. The device according to claim 1, wherein said applicator member constitutes a sponge.

23. The device according to claim 1, wherein said element is secured to a support.

24. The device according to claim 23, wherein said element includes a central region and a peripheral region, wherein said element is fixed via said central region to said support and said peripheral region is unencumbered.

25. The device according to claim 23, wherein said support constitutes a handle.

26. The device according to claim 1, wherein said surface for applying said substance is outwardly concave.

27. The device according to claim 1, wherein said applicator member presents two surface portions for use in applying said substance, said surface portions having differing surface textures.

28. The device according to claim 1, wherein said element further includes flocking.

29. The device according to claim 1, wherein said abrasive treatment is performed by one of an abrasive wheel, a milling cutter or a brush.

30. The device according to claim 1, wherein said abrasive treatment is performed while said element is compressed.

31. A kit for packaging and applying a cosmetic product comprising:

a receptacle containing a cosmetic and an applicator device according to claim 1.

32. The device according to claim 1, wherein said element is treated with an abrasive element so as to form said fibers.

33. The kit according to claim 31, wherein said element is a cellular element.

34. The kit according to claim 33, wherein said cellular element is a foam.

35. The kit according to claim 34, wherein at least a portion of said fibers is constituted by a plurality of walls of burst cells.

36. The kit according to claim 34, wherein said surface of said foam includes at least one crater, said crater having a depth of not less than 0.4 mm.

* * * * *

UNITED STATES PATENT AND TRADEMARK OFFICE

CERTIFICATE OF CORRECTION

PATENT NO. : 7,083,351 B2
APPLICATION NO. : 10/438363
DATED : August 1, 2006
INVENTOR(S) : Jean-Louis Gueret It is certified that error appears in the above-identified patent and that said Letters Patent is hereby corrected as shown below:

Column 2, line 33, delete “serving” and insert therefor --serves--.
Column 2, line 64, delete “mak-” and insert therefor --makes--.
Column 2, line 65, delete “ing”.
Column 3, line 15, delete “projecting” and insert therefor --project--.
Column 3, line 34, delete “. In” and insert therefor --, however, in--.
Column 3, line 35, delete “having” and insert therefor --which has--.
Column 3, line 46, delete “a” (first occurrence).
Column 4, line 19, delete “forming” and insert therefor --form--.
Column 4, line 56, delete “(”.
Column 4, line 57, delete “)”.
Column 4, line 59, “delete “being” and insert therefor --is--.
Column 5, line 63, delete “. Thus” and insert therefor --, thus--.
Column 6, line 29, delete “being constituted by” and insert therefor --constitutes--.
Column 7, line 16, delete “have” and insert therefor --has--.
Column 7, line 18, delete “have” and insert therefor --has--.

Signed and Sealed this

Thirteenth Day of March, 2007

JON W. DUDAS
*Director of the United States Patent and Trademark Office*